US006459370B1

(12) United States Patent
Barrieau et al.

(10) Patent No.: US 6,459,370 B1
(45) Date of Patent: Oct. 1, 2002

(54) METHOD AND APPARATUS FOR DETERMINING PROPER INSTALLATION OF ALARM DEVICES

(75) Inventors: Mark P. Barrieau, Baldwinville, MA (US); Daniel Laramie, Fitchburg, MA (US); Richard P. Bonneau, Gardner, MA (US); Gary W. Vincent, Lunenburg, MA (US)

(73) Assignee: ADT Services AG, Schaffhausen (CH)

( * ) Notice: Subject to any disclaimer, the term of this patent is extended or adjusted under 35 U.S.C. 154(b) by 0 days.

(21) Appl. No.: 09/305,419

(22) Filed: May 5, 1999

Related U.S. Application Data

(60) Provisional application No. 60/106,796, filed on Nov. 3, 1998.

(51) Int. Cl.[7] ..... G08B 29/00

(52) U.S. Cl. ..... 340/514; 340/506; 340/511; 324/522; 324/527

(58) Field of Search ..... 324/527, 522, 324/523, 524; 340/506, 507, 508, 511, 514, 650, 651

(56) References Cited

U.S. PATENT DOCUMENTS

| | | | | | |
|---|---|---|---|---|---|
| 3,973,257 | A | | 8/1976 | Rowe | 340/418 |
| 4,037,220 | A | | 7/1977 | Beyersdorf | 340/256 |
| 4,059,729 | A | * | 11/1977 | Eddy et al. | 370/249 |
| 4,079,363 | A | | 3/1978 | Wilson, Jr. | 340/276 |
| 4,141,007 | A | | 2/1979 | Kavasilios et al. | 340/500 |
| 4,163,269 | A | | 7/1979 | Helwig, Jr. et al. | 361/42 |
| 4,204,201 | A | | 5/1980 | Williams et al. | 340/521 |
| 4,369,436 | A | | 1/1983 | Lautzenheiser | 340/506 |
| 4,532,471 | A | | 7/1985 | Hurley | 324/110 |
| 4,568,919 | A | | 2/1986 | Muggli et al. | 340/518 |
| 4,896,140 | A | | 1/1990 | Biever et al. | 340/568 |
| 4,954,809 | A | | 9/1990 | Right et al. | 340/516 |
| 5,083,076 | A | | 1/1992 | Scott | 320/2 |
| 5,146,486 | A | | 9/1992 | Lebowitz | 379/40 |
| 5,161,102 | A | | 11/1992 | Griffin et al. | 395/800 |
| 5,334,970 | A | | 8/1994 | Bailey | 340/506 |
| 5,387,899 | A | * | 2/1995 | Dilauro et al. | 340/514 |
| 5,446,439 | A | | 8/1995 | Kramer et al. | 340/326 |
| 5,475,363 | A | * | 12/1995 | Suzuki et al. | 340/506 |
| 5,490,086 | A | | 2/1996 | Leone et al. | 364/492 |
| 5,532,601 | A | | 7/1996 | Weir et al. | 324/539 |
| 5,627,514 | A | | 5/1997 | Morita | 340/507 |
| 5,644,293 | A | | 7/1997 | Right et al. | 340/507 |
| 5,721,530 | A | | 2/1998 | Right et al. | 340/521 |
| 5,933,077 | A | * | 8/1999 | Vogt et al. | 340/506 |

* cited by examiner

*Primary Examiner*—Daryl Pope
(74) *Attorney, Agent, or Firm*—Hamilton, Brook, Smith & Reynolds, P.C.

(57) ABSTRACT

Jumper and ground faults are detected within an alarm system. Jumper detection applies to devices having two or more functions (e.g., audible horn and visual strobe). When operated with a single circuit, jumpers typically remain installed in such devices to provide power to all functions. However, if the devices are installed in alarm systems equipped with multiple functions, the jumpers should be removed to allow functions to operate independently and correctly. To detect unremoved jumpers, all loops to separate functions except one are isolated. After isolation, a predetermined signal is presented to the non-isolated loop and current is compared to a reference value. If jumpers exist between this non-isolated loop and another supposedly isolated loop, the additional parallel resistance produces an abnormal signal. To perform ground fault detection, lines of devices may be sequentially isolated (i.e., disconnected) at the control panel via software control until a previously detected ground fault disappears. The line that is isolated and which causes the fault to disappear is the line containing the fault.

46 Claims, 4 Drawing Sheets

METHOD AND APPARATUS FOR DETERMINING PROPER INSTALLATION OF ALARM DEVICES

RELATED APPLICATIONS

The present application and the inventions claimed herein relate to, and claim the benefit of the earlier filing date of (i.e., claim priority to), formerly filed U.S. Provisional Application for Patent entitled "Method and Apparatus for determining Proper Installation of Alarm Devices," Application No. 60/106,796, filed Nov. 3, 1998, the entire teachings of which are incorporated herein by reference.

BACKGROUND OF THE INVENTION

In a typical alarm system within a building, such as a fire or burglar alarm system, many types of sensors, detectors, lights, strobes, sounders and other associated devices may be located throughout the building as part of the system. Groups of these devices are often wired together along one or more pairs of electrical lines used to supply power and communications to the devices. A group of such devices wired on commonly shared pair of lines is often referred to as a line of devices. Many separate lines of devices typically connect back to a control panel that controls the overall operation of the alarm system. A line of devices is usually associated with a certain zone of the building and/or a certain type of device. For example, one floor of a multi-story building may have all of its smoke detectors wired together on a line that connects back to the control panel.

There may be multiple functions associated with each device on a line. For instance, a device may have a horn to sound an alarm upon the detection of smoke and may also contain a strobe light that turns on to guide people to safety during an alarm condition. Industry standards have been developed to govern how the various functions within devices should operate with the control panel and in relation to each other.

Different jurisdictions have different laws that govern the design of alarm systems. For example, some jurisdictions require that horns and strobes be controlled by the panel through separate loops in order that, once fire fighters have arrived, the horns can be silenced while the strobes continue. In those jurisdictions, where each notification appliance includes both a horn and a strobe, the horn and strobe circuits are isolated and separately powered through connections to separate loops. On the other hand, in jurisdictions where the separate loops are not required, it may be desirable to control both the horn and strobe from a single loop to reduce system costs. In order to provide horn/strobe notification appliances which are compatible with both jurisdictions, jumpers may be included between the horn and strobe circuits. When powered by a single loop, the jumpers are left in place. When powered by separate loops, the jumpers are manually removed during installation to isolate the horn and strobe devices. Unfortunately, one or more sets of jumpers may be inadvertently left connected in a two-loop system. The result is a short circuit between the loop which can cause the devices in the loop to operate erratically or even damage the devices during an alarm condition.

Another fault which can occur during installation and even subsequent to installation is a ground fault. Alarm systems are generally not connected to earth ground. Thus, in a 24 volt system, system ground might float at about 12 volts below earth ground as the positive 24 volt level floats about 12 volts above earth ground. Conventional systems include ground fault detectors which identify when there is a short in the system to earth ground. Again, such a short can cause the system to operate erratically.

Once a ground fault is detected in the system, it must be located in order to correct it. Typically, a technician must remove power from the system and use an ohmmeter to find a ground fault.

SUMMARY OF THE INVENTION

In accordance with the present invention, alarm system faults can be detected by selectively isolating loops in the system under programmed processor control while monitoring for faults. For example, where all loops but one are isolated from a power supply, the supervisory current through the non-isolated loop will increase where jumpers inadvertently connect that loop to an isolated loop. That increase in current can be compared through a current sensor. Further, where the system ground fault detector indicates a ground fault, the ground fault can be located by selectively isolating individual loops.

An alarm control panel for implementing the present invention may include the usual connectors to plural appliance loops and a voltage control which applies a first voltage to each loop during an alarm state and a reverse voltage to each loop during a supervisory state. In accordance with the invention, the control panel further includes an isolation control which selectively removes the reverse voltage from the selected loops to test for loop circuit faults. The loops to be isolated are selected under software control and faults are indicated to the operator on a control panel display.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
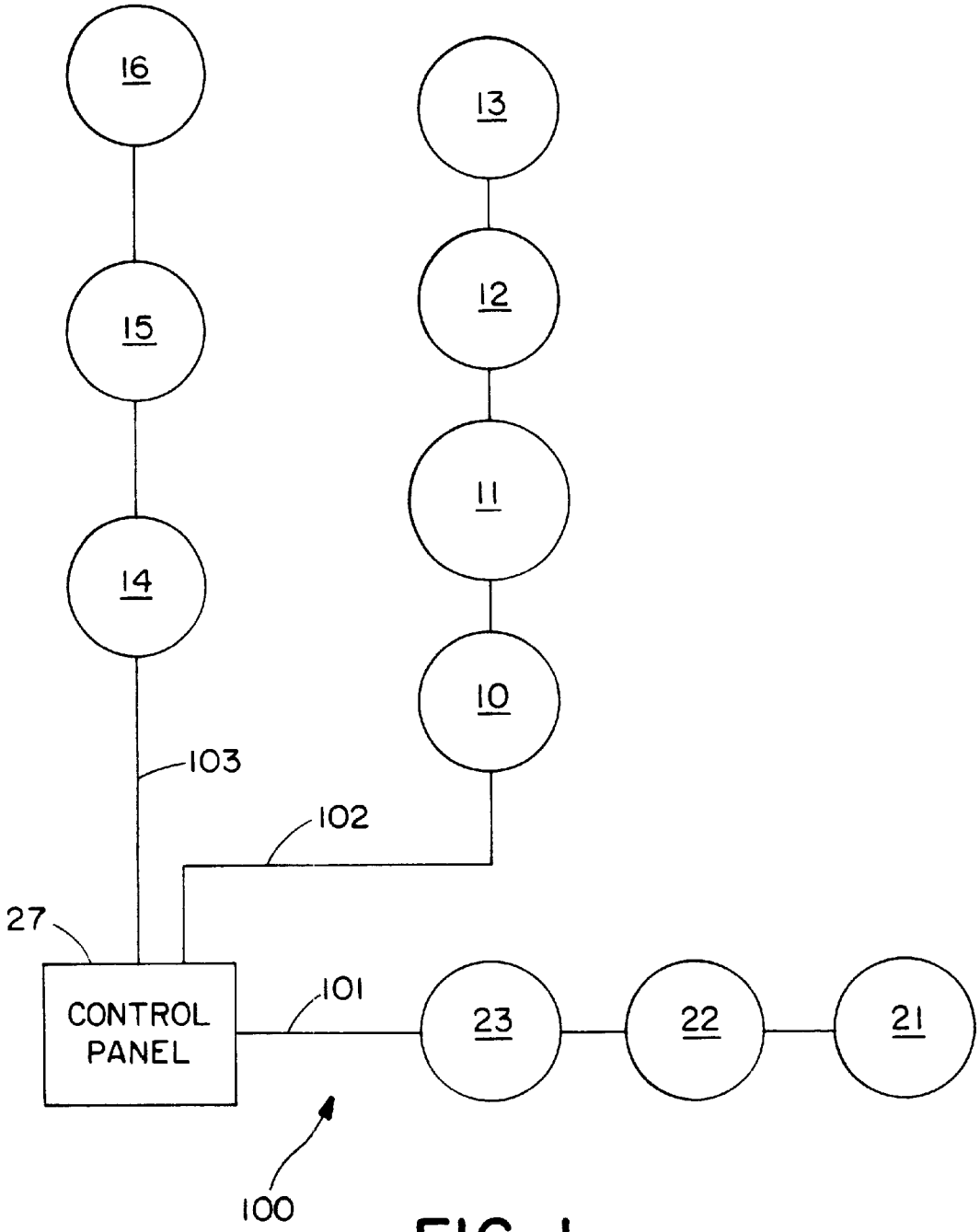
FIG. 1 is an illustration of the architecture of an example alarm system configuration.

FIG. 1 illustrates a high level design of a typical alarm system 100, such as a fire or burglar alarm system. Alarm system 100 includes central control panel 27 which couples lines of devices 101, 102, and 103. Each line of devices 101, 102, 103 includes a plurality of devices, such as devices 21, 22 and 23 on line 101. Each line of devices 101, 102 and 103 is associated with a different geographical area to be covered by the alarm system 100, or each line 101, 102 and 103 may be associated with a particular device type, such as a line of smoke detectors, a line of motion sensors, a line of heat sensors, or a line of notification appliances.

In normal operation of alarm system 100, when a device 10, 11, 12 or 13 detects an alarm condition, the central control panel 27 is notified of the alarm condition via communications over the line from which that device is attached. In response to the alarm condition, the central control panel 27 can control all of the devices on the lines 102 and 103 to activate certain functions associated with each device. As an example, if the device 10 is a smoke detector that detects smoke and signals this condition to the central control panel 27, devices on lines 101 and 103 may be instructed, via the central control panel 27, to activate horns and lights to guide people to safety. Once all people have been evacuated from the emergency situation, the central control panel 27 may then be used to silence the horn function but may instruct devices to keep the light function activated to indicate that the emergency has not been resolved.

In order for the alarm system 100 to operate as described, the installation of lines of devices (e.g., 101, 102, 103) must be performed properly. Once the alarm system 100 is installed, any faults in the alarm system such as unwanted jumpers and shorts to ground must be detected and fixed to ensure correct operation. Ground faults may occur due to faulty installation procedures, defects in circuitry, or other reasons beyond the control of the alarm system operators. The system detects when devices are not installed properly and detects jumper and ground faults within lines of devices 101, 102, 103 in the alarm system 100. Typically, the invention is used during a test period.

Figure 2A:
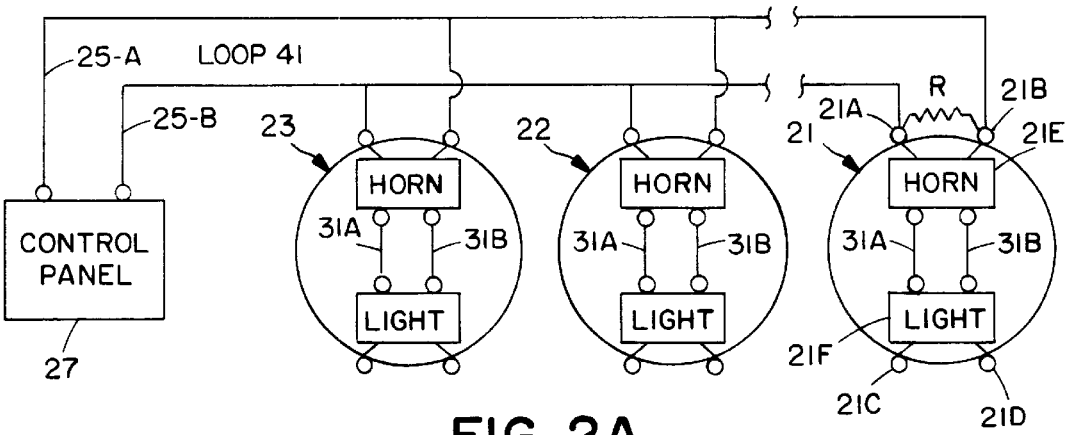
FIG. 2A illustrates the correct interconnection and installation of devices on a line of devices in an alarm system that uses only one loop and that requires jumpers between device functions.
Figure 2B:
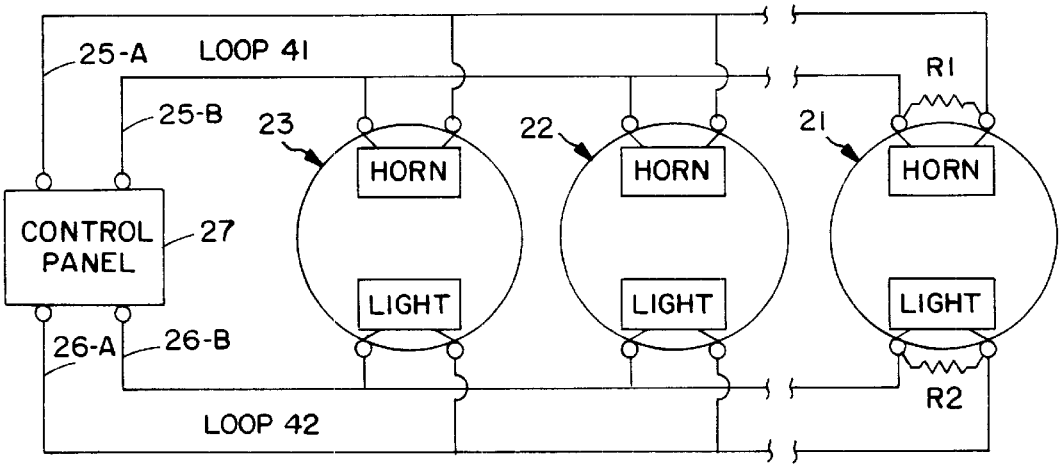
FIG. 2B illustrates the correct interconnection and installation of devices on a line of devices in an alarm system requiring separate loops for each device function.
Figure 2C:
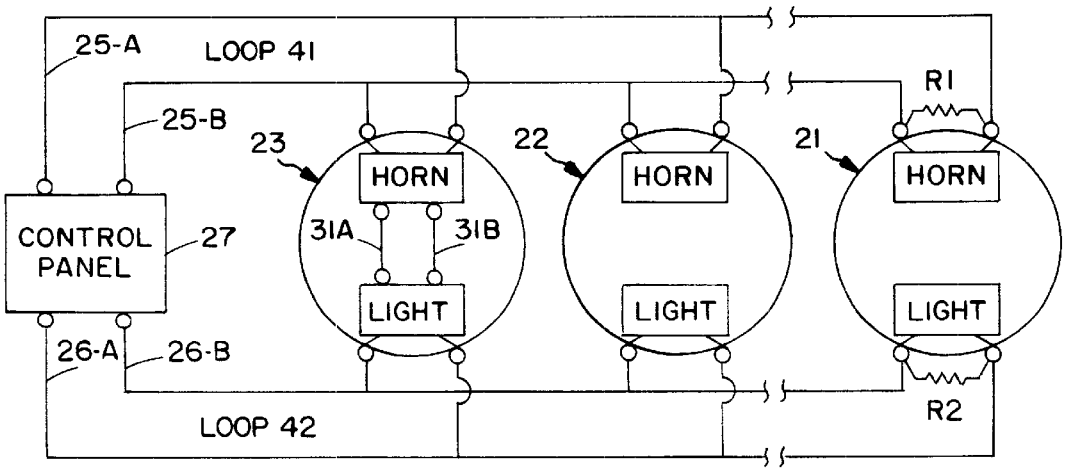
FIG. 2C illustrates the interconnection but incorrect installation of one of the devices in a line of devices in an alarm system for which the invention can be used to detect the installed jumpers in the incorrectly installed device.

FIGS. 2A–C illustrate more detailed views of the internal components of the devices 21, 22 and 23 and installation within the alarm system 100. The device 21 is a multi-function device since two or more functions are provided within the device 21, such as a horn 21E and a light 21F in this example. The device 21 also includes terminal sets 21A, 21B and 21C, 21D for supplying power and communications signals to and from the device 21. The terminal set 21A, 21B is coupled to and associated with the horn function 21E, and the terminal set 21C, 21D is coupled to and associated with the light function 21F. That is, terminals 21A, 21B can control the horn 21E while terminals 21C, 21D can control the light 21F.

As shipped from a manufacturer, the device 21 contains removable jumpers 31A and 31B which come factory installed to allow power and/or communications supplied to one function (i.e., either horn 21E or light 21F) to be supplied to other device functions (i.e., the other one of horn 21E or light 21F) when, as in FIG. 2A, the sets (i.e., 21A, 21B or 21C, 21D) associated with the other device function (s) are not coupled to any power supply or communication wires 25A, 25B and 26A, 26B.

Alarm systems which must adhere to "ADA" alarm system standards supply power and communications to devices on a line on a function by function basis. Such systems thus provide two or more sets or loops of wires, such as 25A, 25B (first loop) and 26A, 26B (second loop) in FIG. 2B, which extend out to each device from the control panel 27. Each set of wires 25A, 25B and 26A, 26B is responsible for supplying power and communications for a specific function in that device. Accordingly, jumpers 31A and 31B should be removed when device 21 is installed in a new alarm system which couples each device function (i.e. horn 21E and light 21F) to a respective terminal set (e.g. 21A, 21B for horn 21E, and 21C, 21D for light 21F) for independent function operation. As previously noted, however, alarm system technicians frequently forget to remove jumpers 31A and/or 31B when installing a device such as device 21.

FIGS. 2A through 2C illustrate three possible configurations for the installation of devices 21, 22 and 23 on line 101 coupled to control panel 27. In FIGS. 2A through 2C, wire sets 25A, 25B and 26A, 26B and the devices 21, 22 and 23 coupled to one or more sets of these wires are collectively referred to as the line of devices 101.

FIG. 2A illustrates a proper installation of devices 21, 22 and 23 in an alarm system configuration which only has a single loop of wires 25A, 25B coupling each device 21, 22 and 23 to control panel 27. Lines 25A and 25B form loop 41 which couples the functions (i.e. horn and light) of each device 21, 22 and 23 to control panel 27. Each device 21,22 and 23 is installed with jumpers 31A and 311 remaining in place. Jumpers 3lA and 311 allow the power and communication signals supplied on lines 25A and 25B to one function of each device 21, 22 and 23 (e.g., the horn in this example) to be simultaneously provided to another function of each device 21, 22 and 23 (e.g., the light).

In order to allow for a supervisory mode of operation, a resistor R is connected between the terminals 21A and 21B of the final device 21 in the loop. During the supervisory mode of operation, the applied voltage is the reverse of that required to drive the devices in the alarm condition. For example, during an alarm condition line 25B might be held to system ground while line 25A is driven to 24 volts. That positive voltage results in current flow through the horns and lights to activate them. During a non-alarm condition, the system is placed in a supervisory mode. In that mode, the line 25A would be held at system ground while 24 volts would be applied to line 25B. The devices 21, 22 and 23 do not conduct current in the reverse direction. To complete the circuit for current flow through the loop in the supervisory mode, the resistor R is placed at the end of the loop. If the loop should ever be broken, the control panel 27 senses the loss in current flow and indicates an open circuit fault.

FIG. 2B illustrates a proper configuration of the same devices 21, 22 and 23 in a system that requires separate power lines 25A, 25B and 26A, 26B to be provided for each individual device function. Lines 25A and 25B form a loop 42 of device functions between the devices 21, 22 and 23 and control panel 27, while lines 26A and 26B form a second loop. Though more than one set of loops (i.e., 25A, 25B and 26A, 26B) couple each device 21, 22 and 23 to control panel 27, the groups of loops 41 and 42 and devices 21, 22 and 23 are collectively referred to as the line of devices.

In the configuration in FIG. 2B, the jumpers 31A and 31B have been removed from each device as they are not needed. Thus, each device 21, 22 and 23 has one function (the horn) coupled to lines 25A and 25B and another function (the light) coupled to lines 26A and 26B. This is the configuration required by many local jurisdictions and allows the control panel 27 to independently operate the separate horn and light functions on each device via the separate power/communication loops 25A, 25B and 26A, 26B. Each loop is terminated by a respective resistor $R_1$, $R_2$ for current flow during supervisory mode.

FIG. 2C illustrates an improper installation of the device 23 within an alarm system that requires separate power lines 25A, 25B and 26A, 26B to be provided for each function. FIG. 2C is generally the same as FIG. 2B, except that device 23 is improperly installed with the jumpers 31A and 31B left in place. Jumpers 31A and 31B can cause problems during alarm system operation, since jumpers 31A and 31B provide a bridge between power/communication loops 41 and 42. By way of example, if control panel 27 attempts to activate only the light functions in devices 21, 22 and 23 via wires 26A, 26B of loop 42, the jumpers 31A and 31B in device 23 in FIG. 2C will provide a connection to the horn function in device 23 and to other devices 21 and 22 on loop 41.

The invention is designed to detect when jumpers are left in place during device installation, and can also be used to detect ground faults that occur within devices or on lines of devices.

Figure 3:
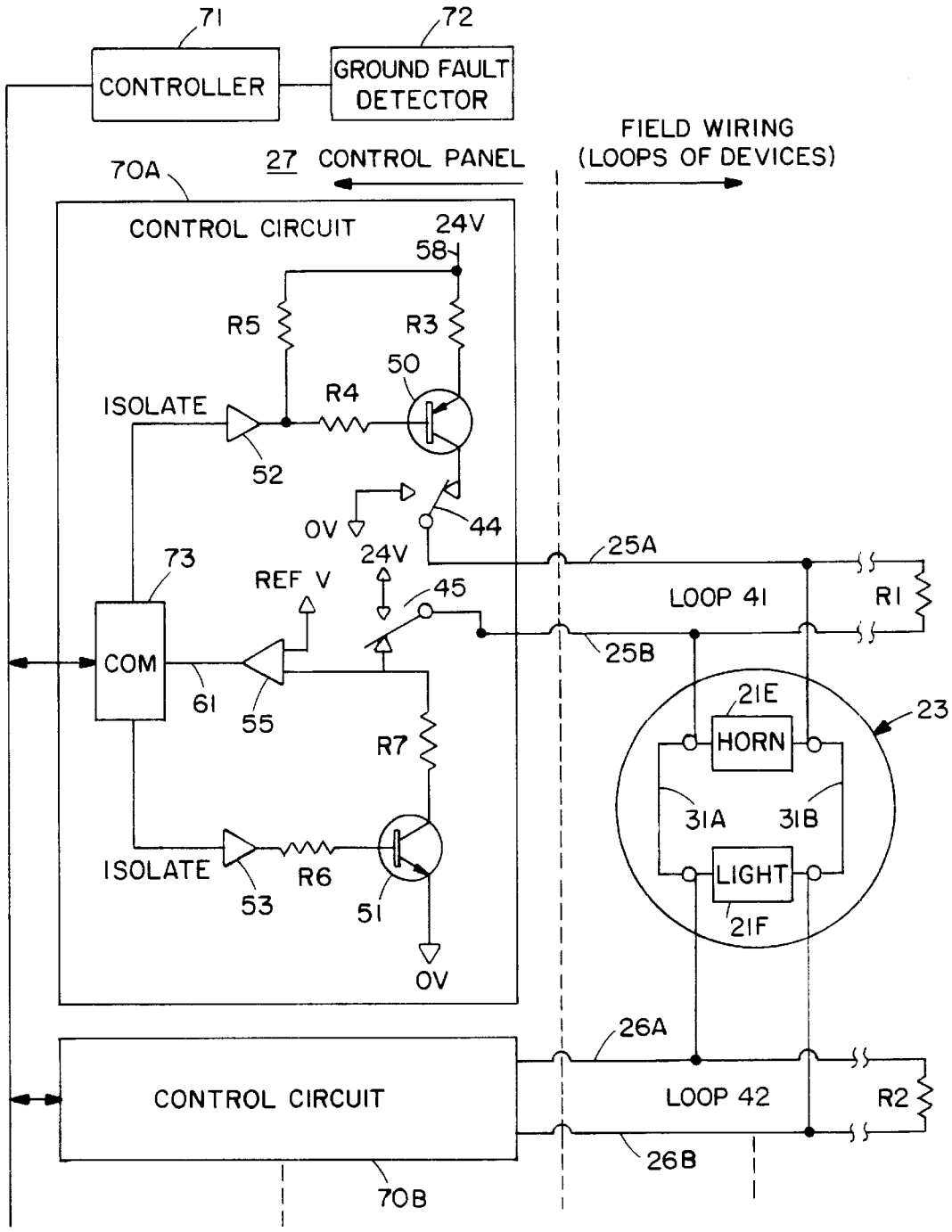
FIG. 3 illustrates details of a preferred embodiment of a circuit that can be used to detect faults within an alarm system configured according to the invention.

FIG. 3 illustrates one embodiment of the invention that can be implemented as a circuit within the control panel 27 of an alarm system. In this embodiment, circuitry contained within the control panel 27 is shown to the left in the figure, while field wiring including line 101 of devices 21, 22 and 23 is shown to the right. In the line of devices 101 in FIG. 3, as was the case in FIG. 2C, device 23 is installed improperly since jumpers 31A and 31B remain in place.

Devices 21, 22 and 23 are coupled to control panel 27 via loops 41 and 42, which are created from wire sets 25A, 25B and 26A, 26B, respectively. Loops 41 and 42 form the line of devices 101. Loop 41 supplies power and communications signals to the horn function 21E in each device 21, 22 and 23, while loop 42 supplies power and communication signals to the light function 21F in each device 21, 22 and 23. Lines of devices 102 and 103 in FIG. 1 may also be configured similarly to the line of devices 101 in FIG. 4.

Control panel 27 includes a control circuit for each loop to control the alarm and supervisory voltages to each. For example, a control circuit 70A couples wires 25A and 25B (loop 41) to the control panel 27, and control circuit 70B couples wires 26A, 26B (loop 42) to the control panel 27. Control circuits 70A and 70B are similarly configured, and thus only circuit 70A is shown in detail. Additional control circuits also are provided for other loops in the system. Control circuits 70A and 70B are controlled by processor 71 in the central control panel 27. Processor 71 controls the overall operation of the alarm system 100 and guides the operation of the invention through communications devices 73 in each control circuit. Ground fault detection circuit 72 can detect the presence, but not the location, of a ground fault somewhere within the alarm system 100 and is coupled to processor 71 to provide a ground fault indication to the processor.

As in a conventional system, each control circuit includes switches 44 and 45 to switch from the supervisory mode shown to an alarm mode. The switches 44 and 45 may be relays, FETs or other devices. In the alarm mode, 24 volts is applied to line 25B and line 25A is connected to system ground. On the other hand, during the supervisory mode, the 24 volt reference is applied from node 58 through a PNP transistor 50 to line 25A, and line 25B is connected to ground through NPN transistor 51. As alternatives to the bipolar devices shown, devices 50 and 51 may be FETs, relays or other switch devices. The transistors 50 and 51 are unique to the circuit to allow each individual loop to be isolated from the system such that it is in neither the alarm nor the supervisory mode. To that end, the controller 71 causes an isolate signal to be applied through operational amplifier 52 and resistor R4 to the base of PNP transistor 50, thus turning the transistor off. The circuit through resistor R5 maintains the high voltage to the gate of transistor 50. Similarly, the complement of the isolate signal is applied to an operational amplifier 53 to drive the output of that device low and turn NPN transistor 51 off through resistor R6.

On the other hand, when the isolate signal is driven low and $\overline{\text{isolate}}$ is driven high, the base of PNP transistor 50 is pulled low to turn that device on and the base of NPN transistor 51 is driven high to turn that device on. With the devices on, current flows in a supervisory mode from the 24 volt pin 58 through resistor R3 and transistor 50 to line 25A and through the loop termination resistor R1, a sensing resistor R7 and transistor 51 to system ground. The voltage across resistor R7 is directly related to the level of current flow through the loop 41. Thus, by comparing the voltage from resistor R7 to a reference voltage in comparator 55, the level of current can be detected. The detect level is communicated to the controller 71 during a test procedure. A comparator 55 may be controllable to compare the voltage on resistor R7 to different voltage levels. For example, as in a conventional circuit, a low reference voltage can be used to detect whether the current is less than that low level, thus indicating an open circuit in the loop. Further, in accordance with this invention, a higher reference voltage can be used to determine whether a higher level of current than normal is flowing through the loop 41, thus indicating the presence of jumpers as discussed below. Rather than a single comparator with multiple references, multiple comparators may be provided, or the comparator may be replaced with an analog to digital converter with the comparison being performed under software control in the controller 71.

In a correctly configured system, only the resistance R1 would be included in the loop 41, resulting in a defined level of current and in a defined voltage on resistor R7. However, with the jumpers 31A and 31B left in the system, it can be seen that the resistor R2 is connected parallel to the resistor R1. The parallel resistance reduces the effective resistance of the loop, thus substantially increasing the current flow through the loop 41. That increased current flow results in an increased voltage across resistor R7 which can be detected by the comparator 55 as a level greater than the high reference voltage level.

Figure 4:
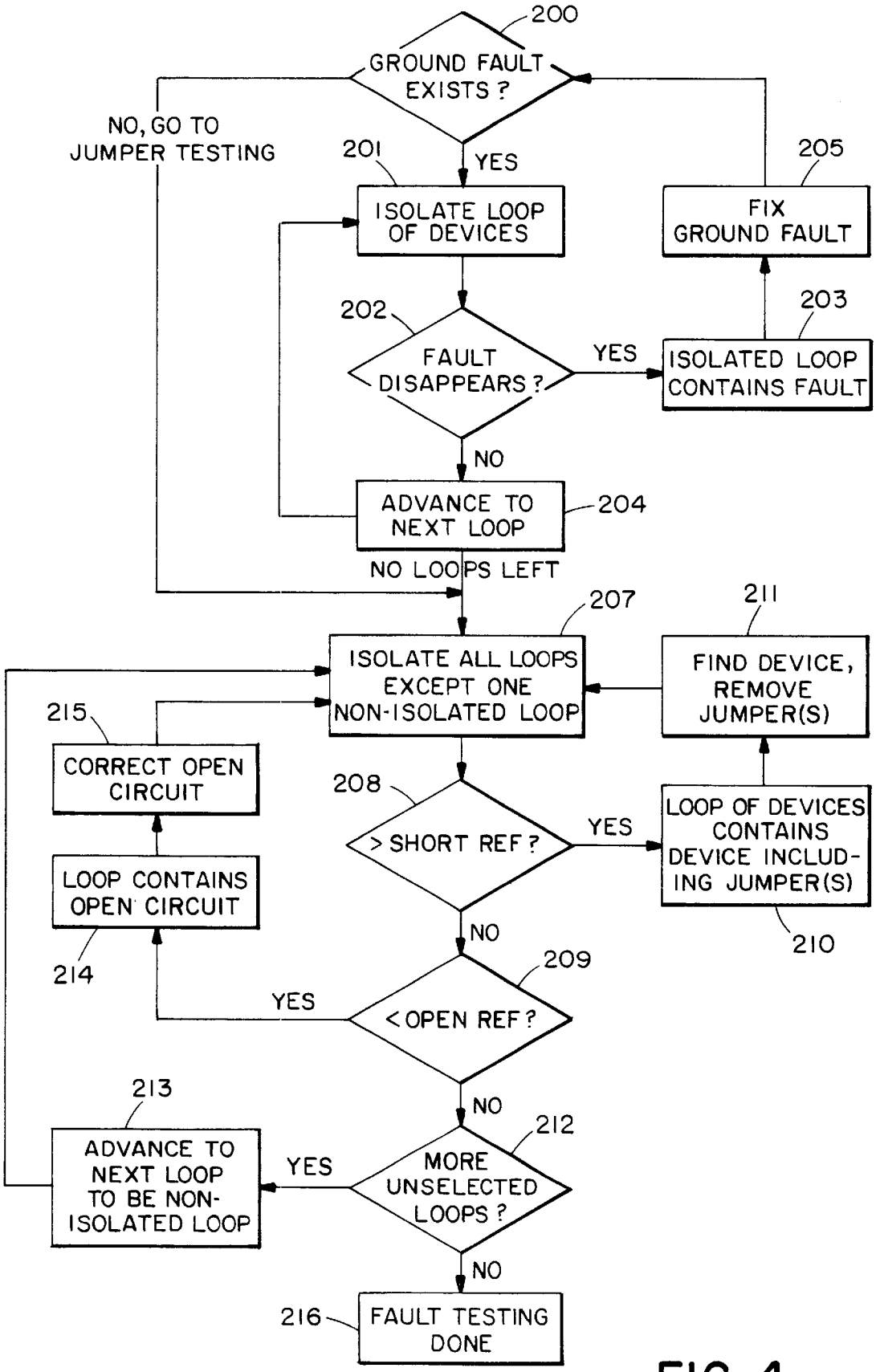
FIG. 4 is a flow chart of the processing steps performed by the invention to accomplish ground fault testing and jumper testing in an alarm system configured according to the invention.

The flow chart in FIG. 4 will be used in conjunction with the circuit in FIG. 3 to described the operation of the invention. The processing steps in FIG. 4 are carried out by the circuitry illustrated in FIG. 3 under control of software in processor 71. In a preferred embodiment of the invention, ground fault testing is performed first, followed by detection of remaining jumpers 31A, 31B installed in devices on a line of devices in an alarm system having separate wire sets, loops 41 and 42, for each function (e.g., horn 21E and light 21F) in a device.

After power up of the alarm system 100, the processor begins at step 200 by determining if a ground fault has been detected by ground fault detection circuitry 72. If a ground fault is detected somewhere in the alarm system 100, processor 71 sequentially isolates individual loops in a search for the loop causing the ground fault at 201. If, when an individual loop, loop 41 for example, is isolated, the fault disappears at 202, it is determined that that loop caused the fault and an indication is provided at the control panel to the operator at 203. The technician then searches the individual loop for the fault to correct the fault at 205. At this point, the ground fault should no longer exist at 200 and the system moves on to the jumper testing. If, on the other hand, the fault did not disappear at 202, the system moves on the next loop to isolate the next loop, for example, loop 42. As an alternative to the ground fault sequence just described, the system could isolate all devices but one and then sequentially put individual loops into supervisory mode. In that way, more than one ground fault on the system could be detected. Alternatively, other search algorithms such as a binary search could be used to locate the ground fault.

With the ground fault corrected, the system then isolates all loops except one at 207 to initiate a search for jumpers incorrectly left in place. The loops must be individually placed in supervisory mode because if two loops, 41 and 42 for example, were put in supervisory mode the resistor R2 would no longer be seen in loop 41. Thus, the voltage applied to comparator 55 would appear normal until loop 42 were isolated.

With only one loop in the supervisory mode, the voltage on resistor R7 for that loop is compared to the higher short circuit reference voltage in comparator 55. If the voltage exceeds that reference, it is indicated at 210 that the loop of devices contains a fault, likely a remaining jumper, and the problem is corrected at 211. The system then checks again at 208 and should find that the voltage across resistor R7 no longer exceeds the short circuit reference. The system then compares the voltage on resistor R7 to the lower open circuit reference voltage. If the voltage is less than that reference, it is indicated to the operator at the control panel that the loop contains an open circuit at 214 and the open circuit is corrected at 215. (The open circuit reference is also used during the on going supervisory mode after testing.) Finally, with all short circuits through jumpers and all open circuits corrected, the system moves on to the next loop at 212, isolating the prior loop and apply supervisory voltage to the next loop at 213. Finally, once all loops have been checked, the test routine is completed at 216.

As an alternative to the process of FIG. 4, the system could sequence through all loops, placing one loop at a time in supervisory mode, and collect loop information for open circuits and short circuits. Only after completing the test would the specific faults be located and corrected.

The invention thus provides a convenient way to test for the condition when jumpers are mistakenly left installed in alarm system installations, and tests for ground faults on lines of devices as well. The invention greatly speeds up fault diagnosis when testing, installing, configuring and/or reconfiguring alarm systems.

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

What is claimed is:

1. An alarm control panel comprising:

connectors to plural appliance loops;

voltage control which applies a first voltage to each loop during an alarm state and a reverse voltage to each loop during a supervisory state; and isolation control which selectively removes the reverse voltage from selected loops to test for loop circuit faults.

2. An alarm control panel as claimed in claim 1 further comprising a detector for detecting current in each loop.

3. An alarm control panel as claimed in claim 2 which tests for jumpers connected loops.

4. An alarm control panel as claimed in claim 2 wherein the detector comprises a comparator which compares a voltage to a reference level.

5. An alarm control panel as claimed in claim 4 wherein the comparator indicates a short circuit when the voltage exceeds a first level.

6. An alarm control panel as claimed in claim 5 wherein the comparator indicates an open circuit where the voltage is less than a second level, the second level being less than the first level.

7. An alarm control panel as claimed in claim 1 which tests for jumpers connected loops.

8. An alarm control panel as claimed in claim 1 wherein the isolation control isolates all loops except one as a fault is observed.

9. An alarm control panel as claimed in claim 8 which tests for jumpers connected loops.

10. An alarm control panel as claimed in claim 1 which tests for ground faults.

11. An alarm control panel as claimed in claim 1 wherein individual loops are selectively isolated as a system fault is observed.

12. An alarm control panel as claimed in claim 11 which tests for ground faults.

13. An alarm system comprising:

a first loop coupling at least one device to a central control panel;

a second loop coupling the at least one device to the central control panel;

a first circuit coupled to the first loop, the first circuit isolating the first loop from a power supply;

a second circuit coupled to the second loop, the second circuit supplying a voltage to the second loop and detecting current through the second loop, the current indicating if a fault exists between the first and second loops.

14. A system as claimed in claim 13 wherein the current indicates jumpers connected on a device between the first and second loops.

15. A system as claimed in claim 13 wherein the detector comprises a comparator which compares a voltage to a reference level.

16. A system as claimed in claim 15 wherein the comparator indicates a short circuit when the voltage exceeds a first level.

17. A system as claimed in claim 16 wherein the comparator indicates an open circuit where the voltage is less than a second level, the second level being less than the first level.

18. A method of testing an alarm system, having plural appliance loops, for faults comprising:

applying a first voltage to each loop during an alarm state and a reverse voltage to each loop during a supervisory state;

selectively isolating loops in the system under programmed processor control by selectively removing the reverse voltage from the selected loops to test for loop circuit faults; and monitoring the system for faults with selective isolation of the loops.

19. A method as claimed in claim 18 further comprising detecting current through a loop which is not isolated.

20. A method as claimed in claim 19 wherein current above a first level indicates a short circuit in a loop.

21. A method as claimed in claim 20 wherein current below a second level less than the first level indicates an open circuit in the loop.

22. A method as claimed in claim 19 wherein a current below a threshold level indicates an open circuit in the loop.

23. A method as claimed in claim 18 wherein the system is monitored for jumpers between loops.

24. A method as claimed in claim 18 wherein all but one loop is isolated.

25. A method as claimed in claim 18 wherein only a single loop is isolated.

26. A method for determining the location of a fault in an alarm system which includes a control panel and a plurality of loops of devices extending therefrom, the method comprising the steps of:

detecting the existence of a fault within the alarm system;

applying a first voltage to each loop during an alarm state and a reverse voltage to each loop during a supervisory state;

under programmed processor control, selectively isolating loops of devices from the program control panel by selectively removing the reverse voltage from the selected loops to test for loop circuit faults while monitoring existence of the fault; and in a control interface, indicating to an alarm system operator the identification of the loop of devices that caused the fault.

27. A method as claimed in claim 26 wherein the fault is a ground fault.

28. A method for determining the presence of a fault in an alarm system which includes a central control panel and first and second loops extending therefrom, the first and second loops including at least one device installed therebetween, the method comprising the steps of:

isolating the first loop from a power supply;

applying voltage to the second non-isolated loop; and detecting current through the second loop to indicate if a fault exists between the first and second loops.

29. A method as claimed in claim 28 wherein the fault is jumpers connected to the loops.

30. An alarm system, comprising:

a plurality of loops of devices in the alarm system each coupled to a supervisory control circuit, the supervisory control circuit including voltage control which applies a first voltage to each loop during an alarm state and a reverse voltage to each loop during a supervisory state; and a processor which selectively activates supervisory control circuits associated with loops of devices while detecting a fault to selectively remove the reverse voltage from selected loops to test for loop circuit faults.

31. A system as claimed in claim 30 wherein the processor applies a first voltage to each loop during an alarm state and a reverse voltage for each loop during a supervisory state.

32. A system as claimed in claim 30 wherein the fault is detected by detecting current in a loop.

33. A system as claimed in claim 32 wherein the detector comprises a comparator which compares a voltage to a reference level.

34. A system as claimed in claim 33 wherein the comparator indicates a short circuit when the voltage exceeds a first level.

35. A system as claimed in claim 34 wherein the comparator indicates an open circuit where the voltage is less than a second level, the second level being less than the first level.

36. A system as claimed in claim 30 wherein the current indicates jumpers connected on a device between the first and second loops.

37. A system as claimed in claim 30 wherein all loops but one are isolated.

38. A system as claimed in claim 30 wherein only an individual loop is isolated.

39. A system as claimed in claim 30 further comprising a ground fault detector.

40. An alarm system, comprising:

a first loop and a second loop coupling a device installed therebetween to a supervisory control circuit; and a processor which selectively activates supervisory control circuits associated with the loops of devices while detecting a fault between the first and second loops.

41. The alarm system as claimed in claim 40 wherein a first supervisory control circuit isolates the first loop from a power supply.

42. The alarm system as claimed in claim 41 wherein a second supervisory control circuit supplies a voltage to the second loop and detects current through the second loop, the current indicating if a fault exists between the first and second loops.

43. The alarm system as claimed in claim 42 wherein the current indicates jumpers connected on the device between the first and second loops.

44. The alarm system as claimed in claim 42 wherein the second supervisory control circuit comprises a comparator which compares a voltage to a reference level.

45. The alarm system as claimed in claim 44 wherein the comparator indicates a short circuit when the voltage exceeds a first level.

46. The alarm system as claimed in claim 45 wherein the comparator indicates an open circuit where the voltage is less than a second level, the second level being less than the first level.

* * * * *